US007985102B2

(12) United States Patent
Bergner et al.

(10) Patent No.: US 7,985,102 B2
(45) Date of Patent: Jul. 26, 2011

(54) RECEPTACLE FOR INDUSTRIAL INFORMATION NETWORKS COMPRISING AT LEAST TWO CONTACT POINTS

(75) Inventors: Bert Bergner, Bensheim (DE); Gunter Feldmeier, Lorsch (DE); Werner Boeck, Gross-Umstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/499,376

(22) Filed: Jul. 8, 2009

(65) Prior Publication Data

US 2009/0269989 A1 Oct. 29, 2009

Related U.S. Application Data

(63) Continuation of application No. PCT/GB2007/011369, filed on Dec. 21, 2007.

(30) Foreign Application Priority Data

Jan. 11, 2007 (DE) ..... 10 2007 002 466

(51) Int. Cl.
*H01R 24/00* (2006.01)

(52) U.S. Cl. ..... 439/676

(58) Field of Classification Search ..... 439/376, 439/676, 660

See application file for complete search history.

(56) References Cited

U.S. PATENT DOCUMENTS

| | | | | |
|---|---|---|---|---|
| 4,497,526 | A | 2/1985 | Myers | |
| 5,478,261 | A * | 12/1995 | Bogese, II | 439/676 |
| 6,146,182 | A | 11/2000 | Wang et al. | |
| 6,234,827 | B1 | 5/2001 | Nishio et al. | |
| 6,736,681 | B2 | 5/2004 | Arnett | |
| 6,769,937 | B1 | 8/2004 | Roberts | |
| 2003/0216083 | A1 | 11/2003 | Viklund et al. | |
| 2004/0002267 | A1 * | 1/2004 | Hatterscheid et al. | 439/676 |
| 2005/0136747 | A1 | 6/2005 | Caveney et al. | |
| 2005/0272315 | A1 * | 12/2005 | Hatterscheid et al. | 439/676 |
| 2007/0259571 | A1 * | 11/2007 | Chen | 439/676 |
| 2007/0270043 | A1 * | 11/2007 | Pepe et al. | 439/676 |

FOREIGN PATENT DOCUMENTS

| | | |
|---|---|---|
| EP | 0858684 B1 | 6/2001 |
| FR | 2602375 | 2/1988 |

OTHER PUBLICATIONS

DE Office Action dated Sep. 20, 2007, 4 pages.
International Search Report cited in co-pending International Application No. PCT/EP2007/011369, dated Jun. 2, 2008, 2 pages.

* cited by examiner

*Primary Examiner* — Phuong K Dinh
(74) *Attorney, Agent, or Firm* — Barley Snyder LLC

(57) ABSTRACT

The invention relates to a receptacle for standard connections in industrial information networks, in particular an RJ45 jack for Ethernet-based applications. The receptacle includes a socket which opens against a plug-in direction and a plurality of spring contacts. The spring contacts each form a first inclined lead in surface projecting into the socket in the plug-in direction. To allow a downwardly compatible, vibration-resistant connection, it is proposed according to the invention that the spring contacts each form a further second inclined lead in surface offset in the plug-in direction from the first inclined lead in surface.

28 Claims, 6 Drawing Sheets

RECEPTACLE FOR INDUSTRIAL INFORMATION NETWORKS COMPRISING AT LEAST TWO CONTACT POINTS

CROSS-REFERENCE TO RELATED APPLICATIONS

This application is a continuation of PCT International Application No. PCT/GB2007/011369, filed Dec. 21, 2007, which claims priority under 35 U.S.C. §119 to German Patent Application No. 10 2007 002 466.7, filed Jan. 11, 2007.

FIELD OF THE INVENTION

The invention relates to a receptacle for standard connections in industrial information networks, in particular a RJ45 receptacle having a plug socket and a plurality of spring contacts which each form a first and second inclined lead in surface into the plug socket.

BACKGROUND

In industry, standardized data transfer methods from the information network and communications technologies are readily known. Because of its technical versatility and widespread use, Ethernet-based data exchange in accordance with IEEE 802.3 is one such known data transfer method. In the field of office communications, the 8-pin modular connector in accordance with IEC 60603-7-1, also known as the RJ45 receptacle has been successfully used for line Ethernet transfer in connection systems. With these connectors, the spring contacts form an inclined surface towards which a respective plug-side contact travels with a corner thereof.

Because of it's wide and favorable availability, attempts have also been made to use the established RJ45 standard in other industry. However, the performance of RJ45 plugs and receptacles known from office technology has not been found to be sufficient, in particular, for industrial use. In particular, the mechanical load-bearing capacity of the connection and the impermeability to dust and moisture are inadequate.

The draft standard IEC 61076-3-106 discloses fourteen different solutions which have been proposed for adapting the RJ45 standard for industrial applications. In addition, products which utilize the principle followed in the draft standard are known from the market. DE 10 2004 038 123 B4 and WO 02/0673287 A1 disclose electrical connections which are RJ45-compatible and have an enhanced mechanical load-bearing capacity, but which are only suitable to a very limited extent for use in environments which are at risk of pronounced vibrations.

A common feature of these known solutions is that the mechanical load-bearing capacity is achieved solely by the configuration of an outer sheath for the plug and the receptacle. The actual RJ45 connector, consisting of a plug and receptacle is an arbitrarily constructed standard office communications product. The fact that the RJ45 standard plug is not particularly suitable for use under pronounced mechanical stress, because of, among other things, the generous IEC 60603-7-1 tolerances is still problematic. The tolerances, generally result in pronounced play of the plug within the receptacle.

A further problem which does not arise in office technology is that the plug connection can be mounted on a machine in industrial applications and can thus be exposed to continuous vibrations. The play between the receptacle and plug, in the known RJ45 connections, leads to relative movement on the contact points and consequently to damage of the contact surfaces, interruptions in contact and ultimately failure of the connection or loss of packets.

SUMMARY

In view of these drawbacks, it is an object of the invention, among other objects, to provide a downwardly compatible receptacle for standard connections, in particular in accordance with the RJ45 standard, which improves the vibration protection of the plug connection for industrial applications.

The receptacle for standard connections in industrial information networks, in particular for an RJ45 plug for Ethernet-based applications, includes a socket which opens against a plug-in direction and comprising a plurality of spring contacts. Each spring contact is formed to include a first inclined lead in surface that projects into the socket in the plug-in direction. Additionally, each spring contact includes a further second inclined lead in surface, which is offset from the first inclined lead in surface in the plug-in direction, and is superimposed by the first inclined lead in surface in a projection in the plug-in direction.

BRIEF DESCRIPTION OF THE DRAWINGS

The invention will be described in detail with reference to the following figures of which.

DETAILED DESCRIPTION OF THE EMBODIMENT(S)

Figure 1:
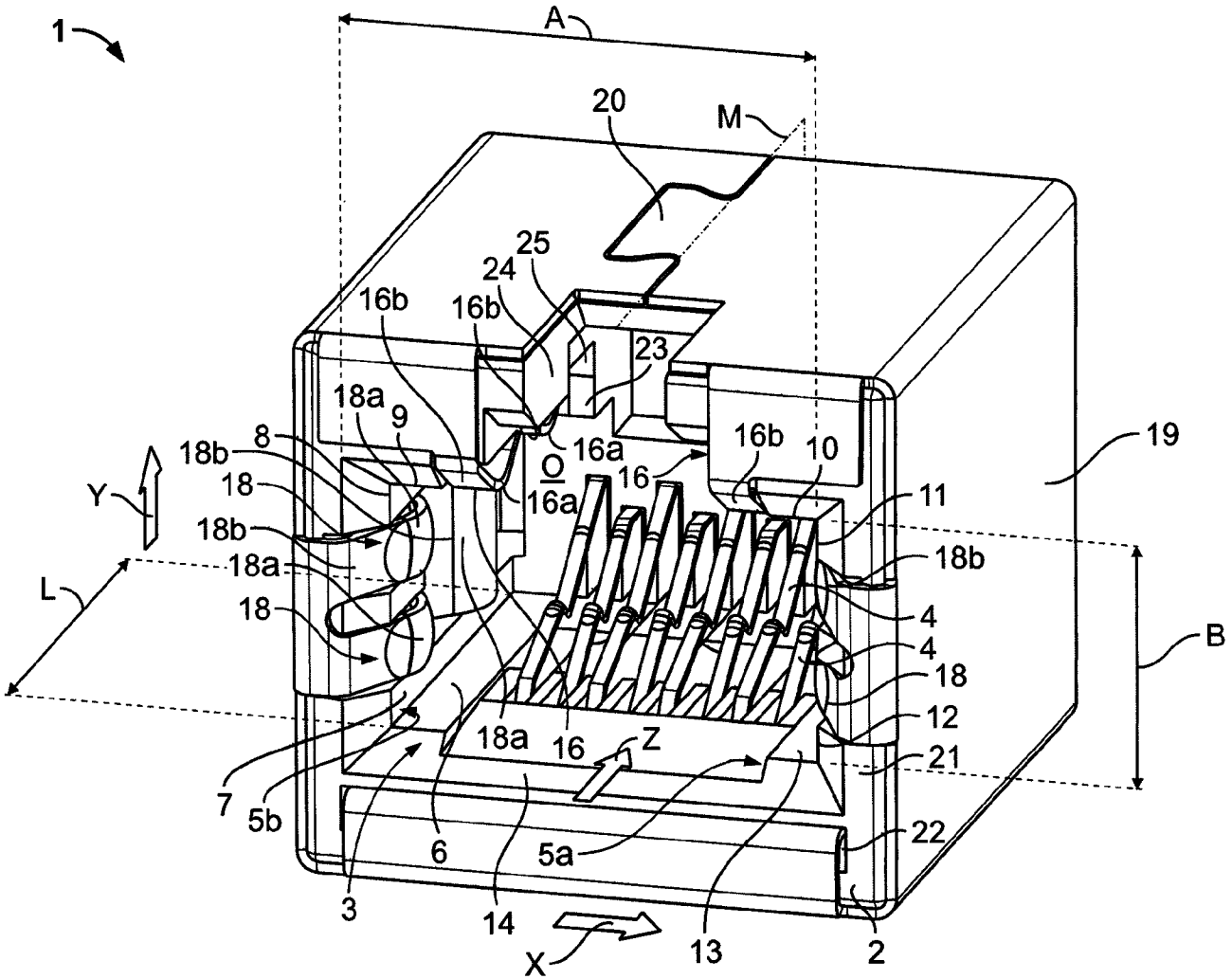
FIG. 1 is a schematic perspective view of a receptacle according to the invention.

The construction of a receptacle 1 according to the invention is initially described with reference to FIG. 1. The receptacle 1 includes a housing 2 which can be formed from an insulative material.

The housing 2 surrounds a socket 3 in the form of a recess which opens outwards against a plug-in direction Z. The socket 3 has a symmetrical configuration in a center plane M and is constructed to receive a complementary plug 33 (FIG. 3), which is to be introduced in the plug-in direction Z.

The receptacle 1 includes a plurality of spring contacts 4 which project from a lateral surface 5*a* of the housing 2 into the socket 3. Eight of the spring contacts 4, which extend parallel to the plug-in direction Z, are provided in the receptacle 1 of, for example, a RJ45 connector shown in FIG. 1.

Figure 2:
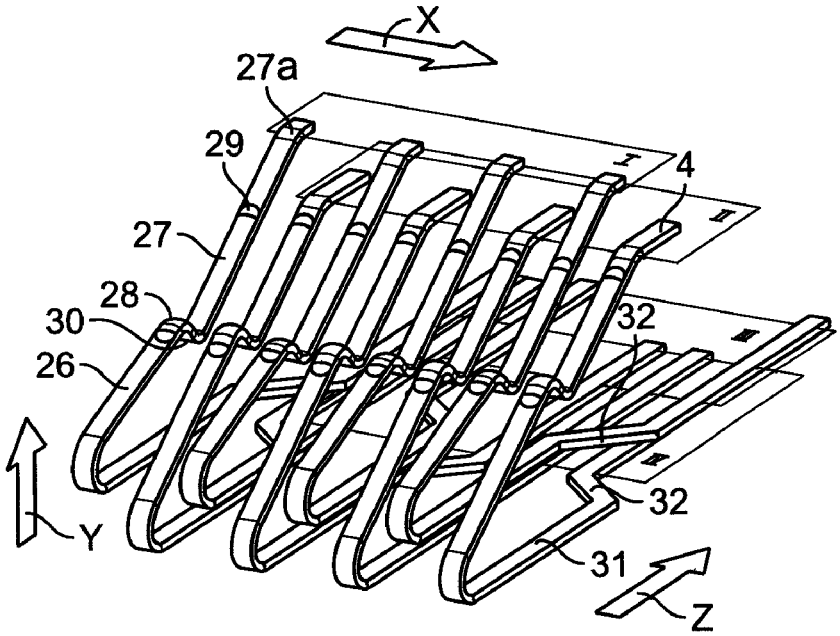
FIG. 2 is a perspective view of spring contacts of the receptacle of FIG. 1.

The configuration of the spring contacts 4 is described in detail below with reference to FIG. 2.

The socket 3 is also provided with planar supporting guide surfaces 6, 7, 8, 9, 10, 11, 12, 13, which extend in the plug-in direction Z, and oppose one another in respective pairs in directions X, Y extending perpendicularly to the plug-in direction Z and are parallel to sides of the socket 3. The pairs of guide surfaces 6, 9 and 10, 13 are mutually opposed in the Y direction and the pairs of guide surfaces 7, 12 and 8, 11 are mutually opposed in the X direction. A distance A between the guide surfaces 7, 8 and 11, 12 in the X direction corresponds to a minimum dimension according to a plug standard of the respective connection system, for example, an RJ45 plug according to IEC 60603-7-1. The same applies to a distance B between the guide surfaces 6, 9 and 10, 13. A length L of the guide surfaces 6, 7, 8, 9, 10, 11, 12, 13 in the plug-in direction Z is greater than a standard length of the respective plug standard, in order to guide the plug 33 (FIG. 3) over a greater length in the receptacle 1 and to reduce its clearance for tilting movements.

An aperture O of the socket 3 is surrounded by an entry bevel 14 which widens against the plug-in direction Z and simplifies the insertion of the plug 33 (FIG. 3) into the socket 3 through the aperture O.

In addition to the spring contacts 4, the receptacle 1 includes a pair of spring elements 16 which additionally fix the plug 33 (FIG. 3) in the socket 3 and reduce the play of the plug 33 (FIG. 3) in the receptacle 1. The spring elements 16 arranged symmetrically with respect to the center plane M of the receptacle 1 project from a lateral surface, remote from the spring contacts 4, of the receptacle 1 in the direction Y into the socket 3 so that its effect opposes the effect of the spring contacts 4. Each of the spring elements 16 preferably form two support points 16*a* which lie in succession in the plug-in direction Z and on which the inserted plug 33 (FIG. 3) rests. The support points 16*a* are formed by curved portions, remote from the housing 2, in the form of bends or kinks which adjoin respective inclined surfaces 16*b* in the plug-in direction Z.

Figure 3:
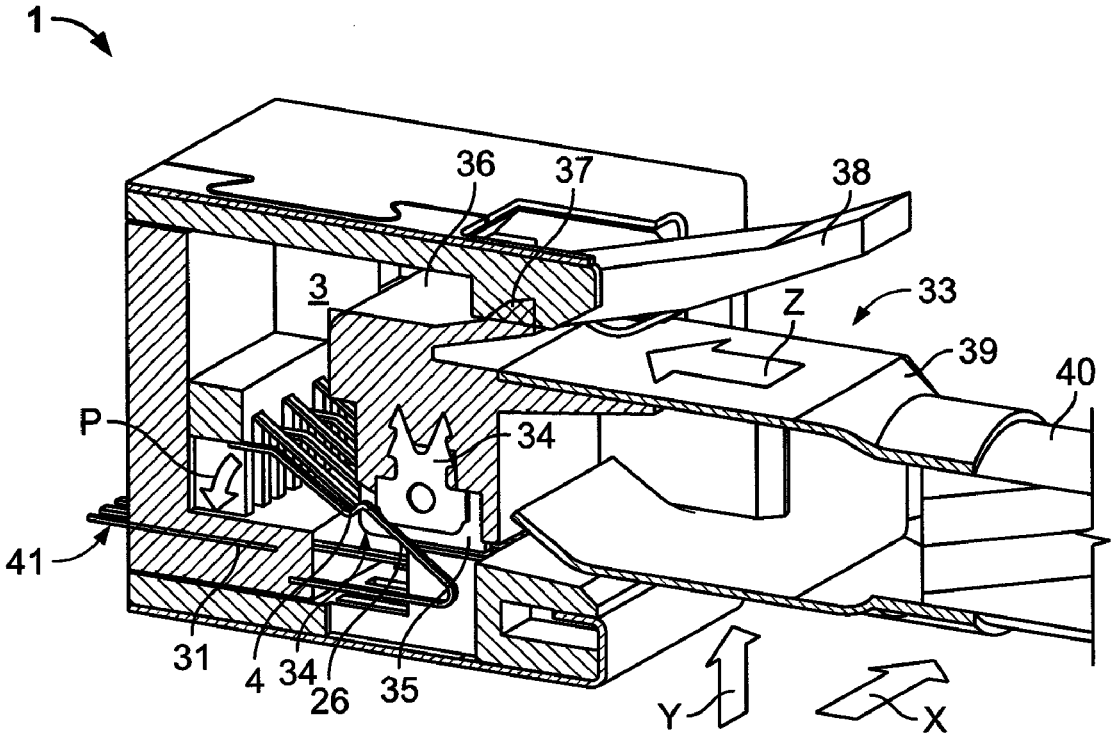
FIG. 3 is a perspective view of the receptacle of FIG. 1 and a plug received by the receptacle in a schematic perspective sectional view.

At least one pair of retaining springs 18 which counteract one another can also be formed on lateral surfaces 5*b* of the socket 3 which oppose one another in the X direction. As shown in FIG. 1, the retaining springs 18 can have a forked configuration and form, for example, three retaining points 18*a* which project into the socket 3 and press against the inserted plug 33 (FIG. 3). Similarly to the support points 16*a* of the spring elements 16, the retaining points 18*a* of the retaining springs 18 are formed by curved portions in the course of the retaining springs 18, for example by kinks or bends. The retaining points 18*a* are each arranged adjacent to inclined surfaces 18*b* extending in the plug-in direction Z.

The retaining springs 18 have a curved profile, at least at the leading retaining points 18*a*, in the plug-in direction Z, into the socket 3. This can be achieved, for example, by impressing a groove in the side remote from the socket 3.

In the embodiment shown in FIG. 1, the retaining springs 18 and the spring elements 16 act as shielding spring contacts which make electrically conductive contact with shielding of the plug 33 (FIG. 3) inserted into the receptacle 1. For this purpose, the spring elements 16 and the retaining springs 18 are preferably shaped integrally on a shielding plate 19 that surrounds the socket 3. As shown in FIG. 1, the shielding plate 19 externally surrounds the housing 2 of the receptacle 1. The shielding plate 19 is manufactured from various materials, folded around the housing 2, and held together by interlocking elements 20. The spring elements 16 and retaining springs 18 are formed by punched-out projections of the shielding plate 19. Furthermore, the spring elements 16 and retaining springs 18 are bent into the socket 3 through the aperture O, surrounding a rim 21 directed against the plug-in direction Z.

A slot 22 can be used for further fixing of the shielding plate 19. The slot 22 prepared in the front surface and directed against the plug-in direction Z of the housing 2

Finally, the housing 2, in the socket 3, forms two stops 23, 24, which are placed in the Z direction and are directed towards one another with the design forming a recess 25 there between and receiving a plug-side latching member 37 (FIG. 3).

The construction of the spring contacts 4 will now be described with reference to FIG. 2. In this embodiment, the reference numerals used in FIG. 1 will be used for the already described elements.

The spring contacts 4 are shaped from punched material or wire material and include two separate inclined lead in surfaces, a first inclined lead in surface 26 and a second inclined lead in surface 27 which are arranged in succession in the plug-in direction Z and are each allocated a contact point 28, 29. The first and second inclined lead in surfaces 26, 27 are mutually superimposed in the projection in the plug-in direction Z, an end 27*a* of the second inclined lead in surface 27, in the plug-in direction Z, projecting further into the socket 3 than the first inclined lead in surface 26.

The first and second inclined lead in surfaces 26, 27 extend at an inclination to the direction Y and the plug-in direction Z into the socket 3 (FIG. 1). In the plug-in direction Z, the first inclined lead in surface 26 ends at the contact point 28 in a curved portion 30 of the spring contact 4, representing a change of direction in the course of the spring contact 4, in other words a kink or a bend. The contact point 29 is arranged in a region of the second inclined lead in surface 27. A further curved portion 30 is arranged after the contact point 28 remote from the housing 2, in the plug-in direction Z, in other words the contact point 28, at a beginning of the second inclined lead in surface 27. The course of the spring contact 4 therefore has a double kink or double bend structure in the projection in the direction Y in the region between the first and second inclined lead in surfaces 26, 27.

At the contact points 28, 29, the spring contact 4 preferably has a concavely profiled cross-section, so the cross-section in the direction X is curved into the socket 3 (FIG. 1). For this purpose, the spring contact 4 can be configured as a hollow profile, for example with a groove on the side remote from the socket 3.

To improve the transfer behavior at high frequencies, the second inclined lead in surface 27, in the plug-in direction Z, end in different respective planes I, II which are mutually spaced in the direction Y. Similarly, connecting lines or portions 31, which connect the spring contacts 4 with contacts arranged outside the receptacle 1 (FIG. 1), also end at planes III, IV. Planes III, IV are also spaced from one another in the direction Y. As shown in FIG. 2, the connecting portions 31 can also be formed in one piece by the spring contacts 4.

A further improvement in the crosstalk characteristic can be achieved if the connecting portions 31 of adjacent spring contacts 4 cross over in the direction X. This can be achieved if the connecting portions 31 have offset portions 32, which lie in a plane substantially parallel to the direction X and the plug-in direction Z, and cross over in the direction Y projection.

Independently of the arrangement of the connecting portions 31 and the ends 27*a* in different planes, the contact points 28 and the contact points 29 each lie in a plane in the case of adjacent spring contacts 4, to ensure that the connection is compliant with the standards.

FIG. 3 is a sectional view through the receptacle 1 of FIG. 1, with the plug 33 incompletely received therein. The plug 33 includes contacts 34 that are arranged in parallel in respective slots 35. The slots 35 are open in the plug-in direction Z and downwardly against the direction Y, and have a width in the direction X that corresponds at least to a width of the spring contacts 4. The slots 35 with the contacts 34 located therein are aligned in the plug-in direction Z with the spring contacts 4. When the plug 33 is inserted into the socket 3, the first inclined lead in surface 26, in the plug-in direction Z, first enters the slot 35 and contacts the contacts 34. As the plug 33 is pressed further into the socket 3 in the plug-in direction Z, a leading corner region 34*a* of the contacts 34 slides along the first inclined lead in surface 26 until the leading contact point 28 rests on the underside of the contacts 34, while the spring contact 4 is simultaneously pressed down in a direction of arrow P. If the plug 33 is now pushed further, it strikes the second inclined lead in surface 27 and presses the second inclined lead in surface 27 with a leading corner region down in the direction of the housing 2. In a final position of the plug 33, the corner region of the contacts 34 rests on the contact point 29. The contact point 28 simultaneously contacts the contacts 34 from below.

The plug 33 includes a leading housing portion 36, in the plug-in direction Z, which is made of a plastic material. The slots 35 are formed in the leading housing portion 36, and is where the contacts 34 are arranged. The latching member 37 includes a handle 38 and is formed in one piece in an elastically deflectable manner by the leading housing portion 36.

A shield 39 made, for example, of sheet metal, surrounds the plug 33 externally over a portion directed towards a cable 40. In the completely inserted state, the shield 39 is contacted by the retaining points 18*a*, located toward the aperture O, of the spring elements 16 and the retaining spring 18 configured as shielding spring contacts. The support points 16*a* and the retaining points 18*a*, in the plug-in direction Z, of the spring elements 16 and the retaining springs 18 preferably rest on the leading housing portion 36 of the plug 33.

FIG. 3 shows that the connecting portions 31 of the spring contacts 4 end outside the receptacle 1 in attachment contacts 41 accessible from outside the receptacle 1.

Figure 4:
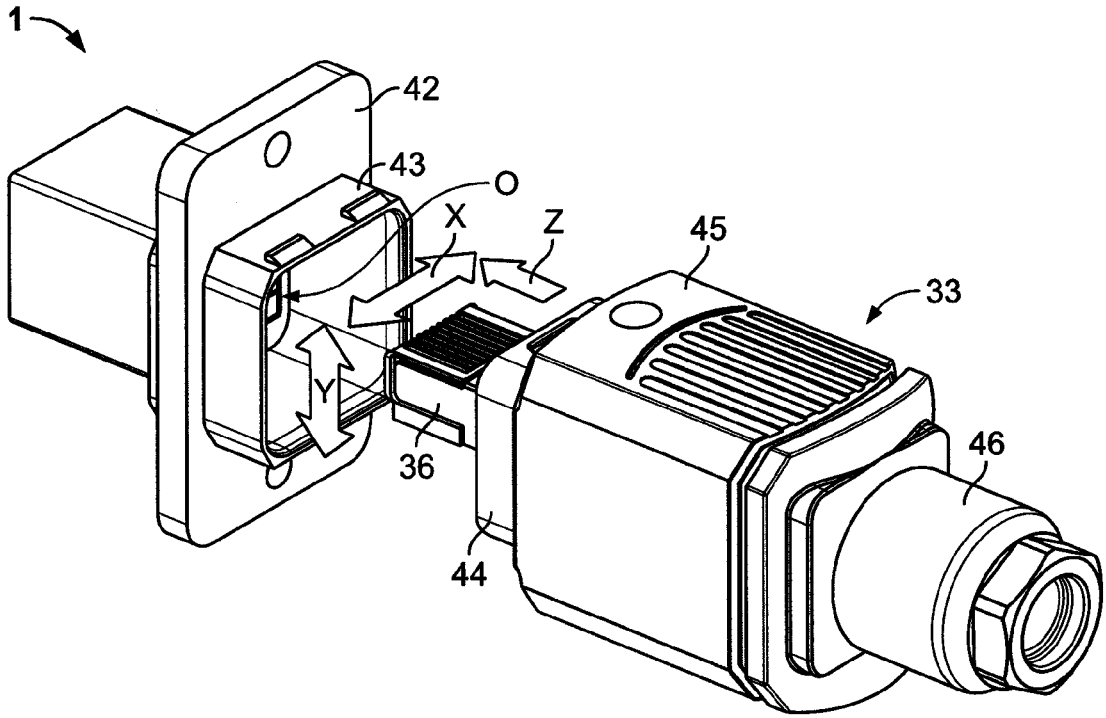
FIG. 4 is a perspective view of a further embodiment of the receptacle and the plug.

FIG. 4 shows a further embodiment of a receptacle 1 and of the plug 33, the same reference numerals being used for elements which are already described above. For the sake of brevity, only the differences from the embodiments illustrated in FIG. 1 to 3 and described above will be discussed.

In FIG. 4, the plug 33 is surrounded by an additional sheathed housing according to IEC 61076-3-106. The receptacle 1 is additionally provided with a collar 43 surrounding the aperture O on its front surface 42 directed towards the plug-in direction Z.

An offset 44, the external contour of which corresponds substantially to an internal contour of the collar 43, is arranged on the plug 33. The offset 44 is insertable into the collar 43 and is capable of striking the front surface 42.

An additional sheath 45 between the offset 44 and a cable fastening means 46 forms a socket, not shown in FIG. 4, for the collar 43, in which the collar 43 can be inserted and locked.

In the embodiment in FIG. 4, the mechanical connection between the cable (not shown) attached to the cable fastener 46 of the plug 33 and a device (not shown) retaining the receptacle 1 is produced by latching the collar 43, the offset 44, and the sheath 45. To keep the leading housing portion 36, in the plug-in direction Z, free of play, without imposing excessive requirements on the accuracy of the manufacture of the socket 3 and the leading housing portion 36, the spring elements 16, and the retaining springs 18 provide a resilient mounting in the direction X and the direction Y, as described above.

Therefore, the configuration of the receptacle 1 described with reference to FIGS. 1 to 3 can also be applied with RJ45 connectors having a particularly high mechanical load-bearing capacity.

Figure 5:
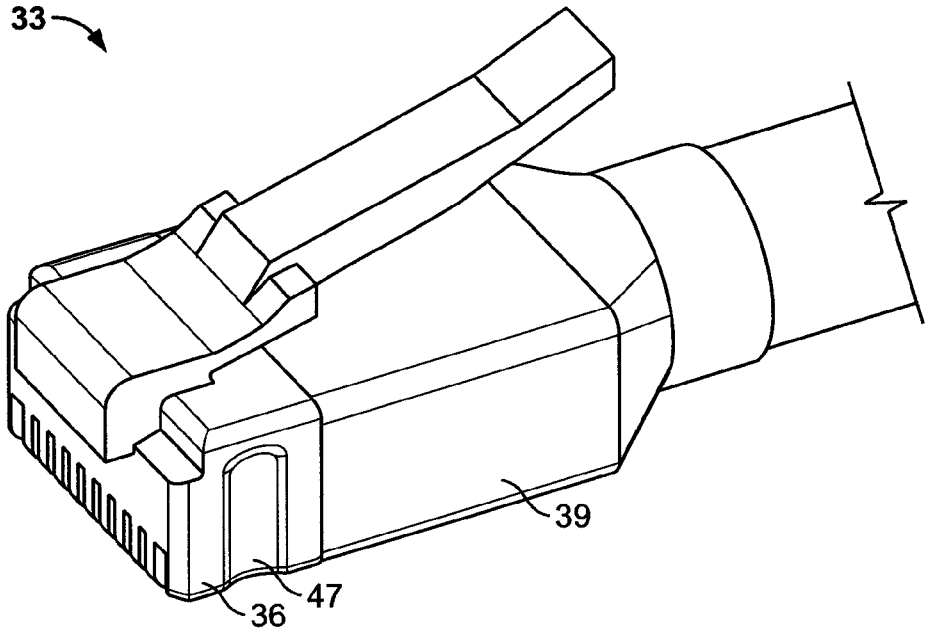
FIG. 5 is a perspective view of a further embodiment of the plug.

FIG. 5 shows an alternative configuration of the plug 33. The plug 33 includes the leading housing portion 36 which is provided with an indentation 47 on a lateral surface associated with the retaining spring 18. The indentation 47 has the function of receiving the trailing retaining points 18*a*, in the plug-in direction Z, of the retaining spring 18, while the leading retaining points 18*a* closer to the aperture O still have the function of contacting the shield 39 of the plug 33.

Different embodiments of the spring contact 4 will now be described with reference to FIGS. 6 to 9, like reference numerals being used for like above-described elements.

Figure 6:
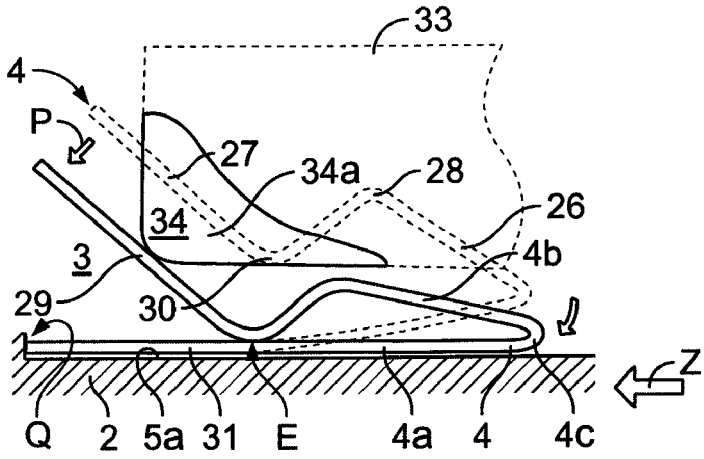
FIG. 6 is a side view of a further embodiment of the spring contacts.
Figure 7:
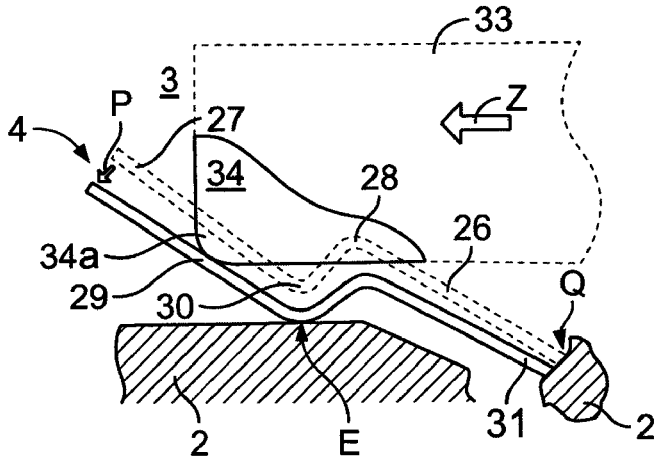
FIG. 7 is a side view of a further embodiment of the spring contacts.
Figure 8:
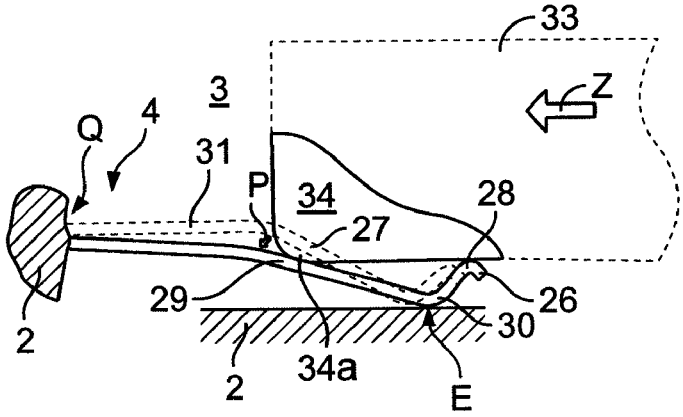
FIG. 8 is a side view of a further embodiment of the spring contacts.

The embodiments in FIGS. 6 to 8 all have a double kink structure, as described above in conjunction with FIG. 2.

FIGS. 6 to 8 each show in a broken line an undeformed state of the spring contact 4, as assumed when the plug 33 is not inserted into the receptacle 1. The final position of the spring contact 4 adopted when the plug 33 is completely inserted is shown in a solid line.

As shown in FIGS. 6 to 9, the two contact points 28, 29 contact the contacts 34 in the end position at two points which are spaced from one another in the plug-in direction Z. In accordance with the standard, the contact point 29 touches the contacts 34 at the leading corner region 34*a* in the plug-in direction Z. The bend directed towards the contacts 34 on the leading contact point 28 touches the contacts 34 on an underside thereof extending in the plug-in direction Z.

The spring contact 4 is fastened in the respective housing 2 at an end Q.

The differences in the embodiments of FIGS. 6 to 9 are described in brief hereinafter.

Figure 9:
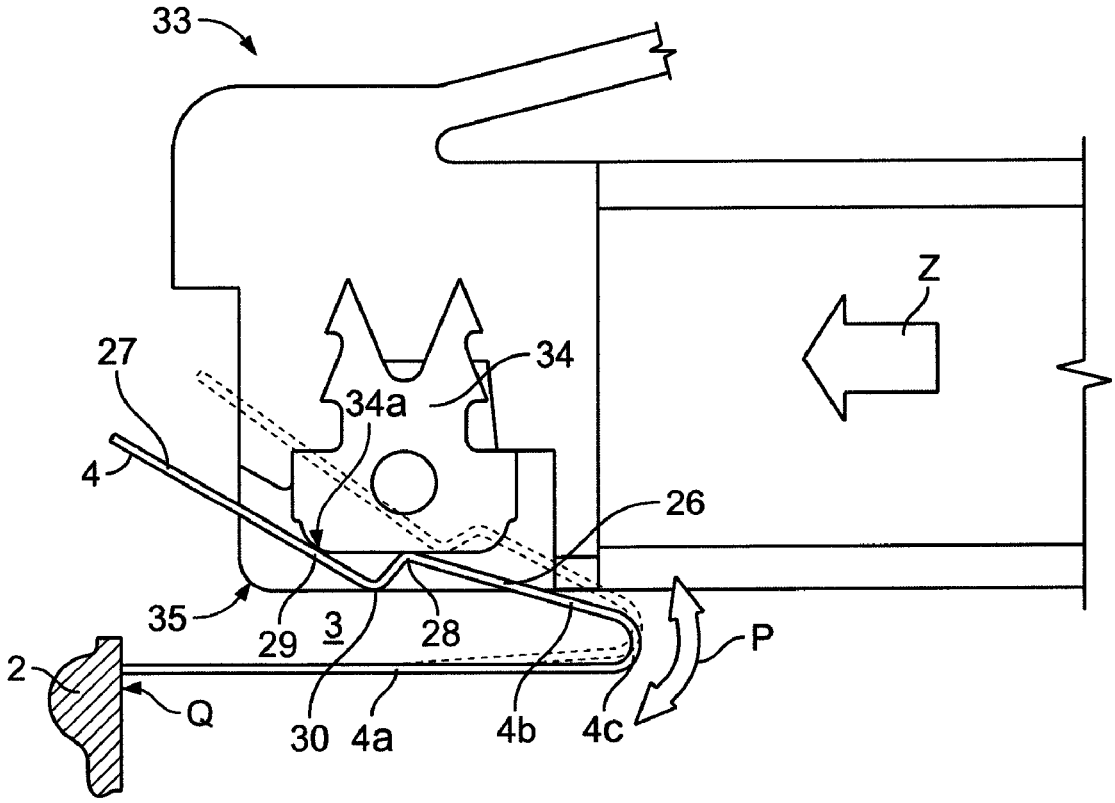
FIG. 9 is a side view of a further embodiment of the spring contacts.

FIGS. 6 to 8 show that the region between the first and second inclined lead in surfaces 26, 27 rests at least indirectly on the housing 2 when the plug 33 is inserted. The curved portion 30 in which the spring contact 4 has a bend directed towards the housing 2 acts as a support E which is pressed towards the housing 2 by the plug 33. In FIG. 9, on the other hand, the spring contact 4 projects so as to vibrate freely, in other words without formation of the support E, into the socket 3. The embodiments of FIGS. 6 to 8 also have the common feature that the curved portion 30 is located in the plug-in direction Z between the two contact points 28, 29 and between the first and second inclined lead in surfaces 26, 27, so that the portions of the spring contact 4 formed by the first and second inclined lead in surfaces 26, 27 form partial springs which act independently of one another on either side of the support E to allow reliable contacting of the contacts 34. In the embodiment of FIG. 6, the spring contact 4 is bent back from the trailing part of the receptacle 1 in the plug-in direction Z lying in a plane substantially parallel to the direction X and the direction Y to form two legs, a base leg 4*a*, and a contact leg 4*b*, which are connected by a bent portion 4*c* extending over approximately 290 degrees to 350 degrees. the base leg 4*a* close to the housing 2 extends along the lateral surface 5*a* against the plug-in direction Z and forms the terminal portion 31. The contact leg 4*b* extending in the plug-in direction Z forms the first and second inclined lead in surfaces 26, 27 and the curved portion 30. In the inserted state of the plug 33, the curved portion 30 forming the support E, on the contact leg 4*b*, contacts the base leg 4*a* and thus shortens the signal path. In this case, the base leg 4*a* rests on the lateral surface 5*a*, at least in certain regions.

In FIG. 7, the connecting portion 31 continues the first inclined lead in surface 26 substantially continuously against the plug-in direction Z towards the housing 2. This embodiment is beneficial, in particular if the attachment contacts 41 (FIG. 3) are arranged on the underside or front side of the receptacle 1.

In the embodiment of FIG. 8, the first inclined lead in surface 26 is markedly shortened and basically only just provided. The second inclined lead in surface 27 passes directly into the connecting portion 31 in the plug-in direction Z.

In the embodiments in FIGS. 7 and 8, the resting of the curved portion 30 on the housing 2 or a printed circuit board 48 (FIG. 10) can be used for contacting purposes and therefore to improve the crosstalk characteristic.

The embodiment shown in FIG. 9 forms the two contact points 28, 29 without the support E. For this purpose, the spring contact 4 extends against the plug-in direction Z into the socket 3. The construction of the spring contact 4 in the embodiment of FIG. 9 is otherwise similar to the construction of the spring contact 4 in the embodiment of FIG. 6 with the base and contact legs 4*a*, 4*b* and the bent portion 4*c*. The difference from the embodiment of FIG. 6 is that the base leg 4*a*, extending against the plug-in direction Z, extends at a distance from the housing 2 and is fixed only at the end Q. The base leg 4*a* is freely movable. When the plug 33 is inserted, the spring contact 4 remains at a distance from the housing 2.

Because of the freely vibrating configuration of the spring contact 4, the angle of the first inclined lead in surface 26 to the horizontal can be adjusted according to the position of the plug 33 in such a way that both the contact points 28, 29 invariably rest on the contacts 34. The curved portion 30 spaced from the contacts 34 together with the tension of the spring contact 4 produced by the plug 33 allows the spring contact 4 to be adapted to different positions of the plug 33 by a tilting movement about the leading corner region 34*a* of the contacts 34. This variation allows a shorter distance between the two contact points 28, 29 in the plug-in direction Z and therefore allows the use of plugs 33 with short contacts 34.

In a modification of the embodiment of FIG. 9, the curved portion 30, when the plug 33 is inserted, can rest on the base leg 4*a* which still has a freely resilient configuration.

Figure 10:
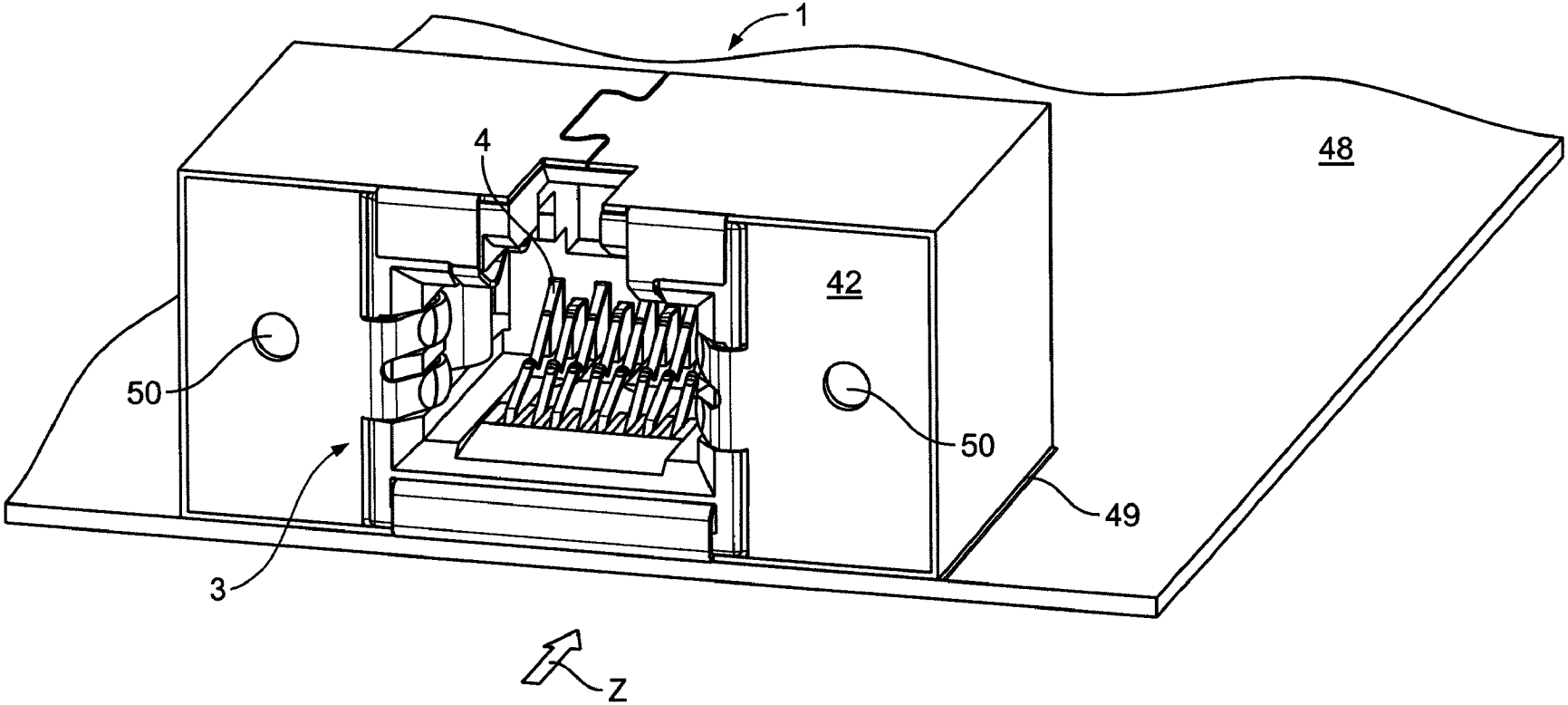
FIG. 10 is a perspective view of a further embodiment of the receptacle according to the invention.

Finally, FIG. 10 shows a further embodiment of the receptacle 1 which is rigidly fixed to the printed circuit board 48 by an interlocking or material fit, for example by means of a soldered joint 49. On the front surface 42, directed against the plug-in direction Z, the receptacle 1 includes a retaining member 50 by which the plug 33 can be fixed rigidly to the receptacle 1. The retaining member 50 can be, for example, a screw connection or a rigid latching member. The configuration of the socket 3 corresponds to the embodiment shown in FIGS. 1 and 3 and allows, in particular, a floating mount of the leading housing portion 36 of the plug 33 pointing in the plug-in direction Z. Owing to the retaining member 50 and the soldered joint 49 to the printed circuit board 48, all forces acting on the cable 40 or the plug 33 are transferred directly to the printed circuit board 48 without this force passing via the spring contacts 4.

The invention claimed is:

1. A receptacle comprising:

a socket which opens against a plug-in direction;

a plurality of spring contacts disposed in the socket, each having a first inclined lead in surface projecting into the socket in the plug-in direction and a second inclined lead in surface which is offset from the first inclined lead in surface in the plug-in direction and is superimposed by the first inclined lead in surface in a projection, wherein the spring contacts are adapted to touch a respectively allocated contact of a plug on two respective contact points in the inserted state, one of the contact points touches the contact at a leading corner region in the plug-in direction.

2. The receptacle according to claim 1, wherein the spring contacts form a respective support in the plug-in direction between the first and second inclined lead in surfaces, the respective support rests at least indirectly on a housing surrounding the socket when the plug is connected to the receptacle.

3. The receptacle according to claim 1, wherein the spring contact projects in a freely vibrating manner into the socket.

4. The receptacle according to claim 1, wherein the spring contact projects in a freely vibrating manner into the socket.

5. The receptacle according to claim 1, wherein the course of the spring contact between the first and second inclined lead in surfaces has a curved portion close to the housing.

6. The receptacle according to claim 1, wherein the course of the spring contact between the first and second inclined lead in surfaces has a curved portion close to the housing.

7. The receptacle according to claim 5, wherein the course of the spring contact has a curved portion between the first and second inclined lead in surfaces close to the housing.

8. The receptacle according to claim 1, wherein the first inclined lead in surface in the plug-in direction, ends at a contact point, remote from the housing, of the spring contact.

9. The receptacle according to claim 1, wherein the spring contact is curved transversely to the plug-in direction into the socket in a region of a contact point of the first inclined lead in surface in the plug-in direction.

10. The receptacle according claim 1, wherein at least one retaining spring projecting into the socket is provided on a lateral surface different from a lateral surface on which the spring contacts are arranged.

11. The receptacle according to claim 10, wherein at least one retaining spring is arranged ahead of the leading contact point in the plug-in direction.

12. The receptacle according to claim 11, wherein at least one pair of retaining springs, which act against one another, is provided.

13. The receptacle according to claim 9, wherein the retaining spring forms two separate inclined surfaces located in succession in the plug-in direction.

14. The receptacle according to claim 1, wherein at least one spring element projects into the socket and counteracts the spring contacts.

15. The receptacle according to claim 11, wherein at least one spring element projects into the socket and counteracts the spring contacts.

16. The receptacle according to claim 1, wherein a length of the socket in the plug-in direction exceeds a dimension predetermined by a plug standard, in that the socket forms guide surfaces extending in the plug-in direction on mutually opposed lateral surfaces and surfaces and in that the distance between the plug guides corresponds approximately to the smallest dimensions of the standard tolerance.

17. An electrical connector arrangement comprising:

a plug having contacts; and a receptacle, having a socket which opens against a plug-in direction and comprises a plurality of spring contacts, each spring contact forms a first inclined lead in surface projecting into the socket in the plug-in direction, each spring contact forms a further second inclined lead in surface which is offset from the first inclined lead in surface in the plug-in direction and is superimposed by the first inclined lead in surface in a projection, wherein the spring contacts are adapted to touch a respectively allocated contact of a plug on two respective contact points in the inserted state, one of the contact points touches the contact at a leading corner region in the plug-in direction.

18. The electrical connector arrangement according to claim 17, wherein the spring contacts touch the respectively associated contacts on two respective contact points, the two contact points being associated with the respective first and second inclined lead in surfaces.

19. The electrical connector arrangement according claim 17, wherein the plug includes at least one indentation which cooperates with a retaining spring positioned within the socket.

20. The electrical connector arrangement according claim 18, wherein the plug includes at least one indentation which cooperates with a retaining spring positioned within the socket.

21. The electrical connector arrangement according claim 17, wherein the plug is resiliently mounted in the receptacle, at least in a direction transverse to the plug-in direction.

22. The electrical connector arrangement according claim 18, wherein the plug is resiliently mounted in the receptacle, at least in a direction transverse to the plug-in direction.

23. The electrical connector arrangement according claim 19, wherein the plug is resiliently mounted in the receptacle, at least in a direction transverse to the plug-in direction.

24. The electrical connector arrangement according claim 20, wherein the plug is resiliently mounted in the receptacle, at least in a direction transverse to the plug-in direction.

25. The electrical connector arrangement according claim 1, wherein the socket is surrounded by a housing.

26. The electrical connector arrangement according claim 25, wherein the housing is externally surrounded by a shielding plate held together by interlocking elements.

27. The electrical connector arrangement according claim 1, wherein the socket includes at least one pair of spring elements and at least one pair of retaining springs.

28. The electrical connector arrangement according claim 27, wherein the spring element and the retaining spring are formed by punched-out projections of the shielding plate and bent into the socket through the plug-in direction surrounding a rim directed against the plug-in direction.

* * * * *